US005757272A

United States Patent [19]

Herzer et al.

[11] Patent Number: 5,757,272

[45] Date of Patent: May 26, 1998

[54] ELONGATED MEMBER SERVING AS A PULSE GENERATOR IN AN ELECTROMAGNETIC ANTI-THEFT OR ARTICLE IDENTIFICATION SYSTEM AND METHOD FOR MANUFACTURING SAME AND METHOD FOR PRODUCING A PRONOUNCED PULSE IN THE SYSTEM

[75] Inventors: Giselher Herzer, Bruchkoebel; Gerd Rauscher, Alzenau, both of Germany

[73] Assignee: Vacuumschmelze GmbH, Hanau, Germany

[21] Appl. No.: 711,089

[22] Filed: Sep. 9, 1996

[30] Foreign Application Priority Data

Sep. 9, 1995 [DE] Germany ..... 195 33 362.4

[51] Int. Cl.[6] ..... G08B 13/14

[52] U.S. Cl. ..... 340/572; 340/551; 148/108; 148/304

[58] Field of Search ..... 340/551, 572; 148/108, 304, DIG. 3; 29/DIG. 25, DIG. 49

[56] References Cited

U.S. PATENT DOCUMENTS

| | | | |
|---|---|---|---|
| 3,802,854 | 4/1974 | Mueller-Dittmann et al. | 29/195 |
| 4,298,862 | 11/1981 | Gregor et al. | 340/572 |
| 4,473,401 | 9/1984 | Masumoto et al. | 148/304 |
| 4,660,025 | 4/1987 | Humphrey | 340/572 |
| 4,823,113 | 4/1989 | Hasegawa | 340/551 |
| 4,950,550 | 8/1990 | Radeloff et al. | 428/611 |
| 5,568,125 | 10/1996 | Liu | 340/551 |

FOREIGN PATENT DOCUMENTS

| | | |
|---|---|---|
| 0 309 679 | 5/1989 | European Pat. Off. . |
| 29 33 337 | 3/1981 | Germany . |

OTHER PUBLICATIONS

"Induction of bistability of Low-Magnetostriction Amorphous Ribbons," Rodriguez et al. J. of Mag. & Mag. Matls. vol. 133, (1994), pp. 36–39.

*Primary Examiner*—Jeffrey A. Hofsass
*Assistant Examiner*—Anh La
*Attorney, Agent, or Firm*—Hill & Simpson

[57] ABSTRACT

For security against theft or for identification of products using an electronic alternating field in an interrogation zone, a pulse generator, upon magnetic reversal due to a Barkhausen jump, exhibits an impulse behavior that produces characteristic harmonics and largely prevents confusion with other magnetically soft materials in the interrogation zone. This pulse generator is formed of an amorphous strip or an amorphous wire with a cobalt content of at least 20 at-%, subjected to a heat treatment by a current flowing through the strip or wire, to produce a ratio of remanence induction to saturation induction of between 0.2 and 0.9.

56 Claims, 5 Drawing Sheets

ELONGATED MEMBER SERVING AS A PULSE GENERATOR IN AN ELECTROMAGNETIC ANTI-THEFT OR ARTICLE IDENTIFICATION SYSTEM AND METHOD FOR MANUFACTURING SAME AND METHOD FOR PRODUCING A PRONOUNCED PULSE IN THE SYSTEM

BACKGROUND OF THE INVENTION

1. Field of the Invention

The invention is directed to an elongated member for electromagnetic anti-theft or article identification systems of the type having a strip of amorphous material, whose magnetization is suddenly reversed by a reversal of magnetization in an interrogation zone with a magnetic alternating field when determinate threshold values are attained, thereby producing a Barkhausen discontinuity (Barkhausen jump) triggering characteristic voltage impulses in an interrogation coil.

The invention is also directed to a method for making such an elongated member for serving as a pulse generator in an electromagnetic anti-theft or article identification system.

The invention is also directed to a method for producing a pronounced, easily and unambiguously identifiable impulse in such an electromagnetic anti-theft or article identification system.

2. Description of Prior Art

A ferromagnetic wire is known from German OS 29 33 337 that contains two layers that are supported against one another and that undergoes a sudden reversal of magnetization in an alternating field upon exceeding or undershooting determinate threshold values. This wire can be used, among other things, as a security strip for alarm systems. Caused by the Barkhausen jump, a characteristic signal results, which can be recognized, for example, by the evaluation of harmonics in an interrogation coil, and which cannot be confused with signals of other magnetic parts. This known ferromagnetic wire requires relatively high field strengths, however, the production of which requires relatively high alternating fields, e.g. in an interrogation zone at the exit of a store. It is desirable, however, to use the lowest fields possible, in order to be able to make the interrogation zone wide enough and in order to keep health risks as low as possible for persons moving through the interrogation zone.

German PS 38 24 075, corresponding to U.S. Pat. No. 4,950,550, teaches the use of determinate magnetically soft and magnetically hard materials supported against one another to form a compound member can be used for anti-theft or identification systems and that produces a signal with a low amplitude interrogating alternating field. The hard magnetic components of this compound body with impulse behavior can be exploited in order to deactivate the anti-theft strip by magnetization, and thus saturation, of the magnetically soft part. The deactivated strip can then be transported through the interrogation zone without triggering an alarm.

Since a strip for anti-theft systems should also be suited for protecting or identifying low-cost products, it is necessary to provide a strip that is constructed as simply as possible and is thus relatively inexpensive. A strip of this sort is known, for example, from U.S. Pat. No. 4,298,268. This patent proposes to provide a strip made of amorphous material, since the amorphous material has an unusually high permeability, and thus likewise there is only a slight risk of confusing it with other magnetically soft objects. In addition, it is proposed in this patent to create regions with high coercivity within the amorphous ribbon by the incorporation of crystalline areas in the amorphous ribbon, which regions can again contribute to the deactivation of the strip upon magnetization. The resulting advantage is that for deactivation a magnetically hard material does not have to be additionally incorporated into the strips. In practice, however, it has been found to be difficult to produce crystalline areas with sufficient coercive field strengths, thus causing relatively long strips to be required to ensure an acceptably reliable reaction of the monitoring equipment.

In addition, the amorphous strips are heat-treated in a longitudinal field in order to increase permeability. A very steep curve of magnetic reversal (induction dependent on the effective field strength) is thereby achieved, but not the particularly steep impulses that can be achieved with an impulse wire that suddenly undergoes a magnetic reversal due to a Barkhausen jump, independently of the rapidity of changes in the field.

In addition, it is known from U.S. Pat. No. 4,660,025 to use a strip of from an amorphous ribbon for anti-theft systems that has not undergone heat treatment and (produced by the manufacturing process) has inner stresses generated by rapid quenching from the molten liquid state. The inner stresses in the wire or ribbon again cause Barkhausen jumps upon a reversal of magnetization, so that the same effect as with the impulse wire thereby results. In addition, the advantage is achieved that strips can be manufactured at a lower cost, which, moreover, require only a low field strength of the interrogating alternating field. A disadvantage of the last-described arrangement, however, is that the strips are very sensitive to stress, and even slight deformations cause the inner stresses, and thereby the Barkhausen jumps that arise, to change upon reversal of magnetization. This means that the monitoring equipment for the recognition of the strip must either be set with low sensitivity, which allows false alarms caused by other magnetic materials, or with a sensitive setting of the monitoring equipment, not all the strips used for the anti-theft system will trigger an alarm.

From Journal of Magnetism and Magn. Mat. 133 (1994), pp. 86–89, it is known to produce a customized magnetization reversal behavior in an amorphous strip that exhibits Barkhausen discontinuities. This holds even for amorphous materials that have a magnetostriction close to zero, as is the case, for example, for amorphous strips that contain cobalt. These amorphous strips without magnetostriction have the advantage, in comparison with magnetostrictive strips, that they largely retain their magnetic characteristics while being bent and also in the bent state, so that the strip does not necessarily have to maintain an elongated straight shape, and can be better adapted to the shape of the product to be identified or protected.

SUMMARY OF THE INVENTION

An object of the present invention is to provide a strip or wire (i.e., a pulse generator) for anti-theft or identification systems that produces a definite signal with low switching field strengths, has a definite impulse behavior due to sudden reversal of its magnetization direction (i.e., its polarity) as a result of a Barkhausen jumps, and can be manufactured inexpensively, and generates a sufficiently high characteristic signal even for relatively short strips.

The above object is achieved in a strip that is made of an amorphous material having a cobalt portion of at least 20 at-% (20 atomic percent), and obtains its characteristic for pulsed reversal of magnetization by means of a heat treatment for setting the magnetic anisotropy in a strip through which current flows, and wherein the current through the strip is set in connection with the temperature and the duration of the heat treatment to produce a ratio of induction to saturation induction of between 0.2 and 0.9.

It has been determined that an inventively heat-treated amorphous strip made of a cobalt-based alloy triggers particularly high impulse voltages in the interrogation coil, in particular when determinate values of remanence induction to saturation induction are maintained, which voltages result from the periodic magnetic reversal of the strip and the Barkhausen jumps that are thereby triggered. According to the invention, it is recognized that the use of amorphous strips of this sort permits relatively short anti-theft strips (less than 50 mm), and that sufficiently high impulse voltages nonetheless result, which again trigger characteristic evaluatable harmonics in the interrogation coil.

The behavior of the inventive strip can be improved if the anti-theft identification strip is produced not just from the amorphous strip, but overall strip is made from this amorphous strip and a magnetically soft material connected therewith that continually reverses its magnetization.

A manner of operation then results that is similar to that specified in European Application 309 679 for an impulse wire made of two materials supporting to one another. In contrast to the known impulse wire, however, the inventive amorphous strip has a very much smaller coercive field strength. A particularly effective increase in the impulse level can be achieved by using a magnetically soft material whose coercive field strength is less than 30 mA/cm, and if the cross-section multiplied by the saturation induction is higher than the remanence of the strip with impulse behavior. This can be achieved by using an amorphous or nanocrystalline alloy with a sufficient cross-section being provided for the magnetically soft strip. It is particularly advantageous for the length of the magnetically soft strip to be larger than the length of the strip with impulse behavior.

As in standard impulse wires, in the strips according to the invention it can also be achieved, by means of a permanent magnet connected therewith, that an asymmetrical signal is triggered, i.e. a sudden reversal of magnetization at different threshold values of the magnetic field, depending on the direction of magnetization. This is explained in more detail for impulse wires in European Application 156 016.

It is particularly advantageous if the material for the strip is made of an alloy satisfying the formula $$Co_aNi_b(Fe,Mn)_c(Si,B,X)_d,$$

whereby, in at-%, a=20–85; b=0–50; c=0–15 and d=15–30, whereby a+b+d+c, including standard impurities, equals 100, and X designates one or more of the transition metals of groups IIIB–VIB, in particular Nb, Mo, Ta, W, V, and/or one or more elements of the main groups IIIA–VA, in particular C, P, Ge. In particular, alloys of composition (in at-%):

1) $Co_{74.5}Fe_{1.5}Mn_4Si_{11}B_9$ and

2) $Co_{72}Fe_{1.1}Mo_1Mn_{4.2}Si_{13.2}B_{8.5}$ are suited for use as anti-theft security strips according to the invention.

DESCRIPTION OF THE PREFERRED EMBODIMENTS

Figure 1:
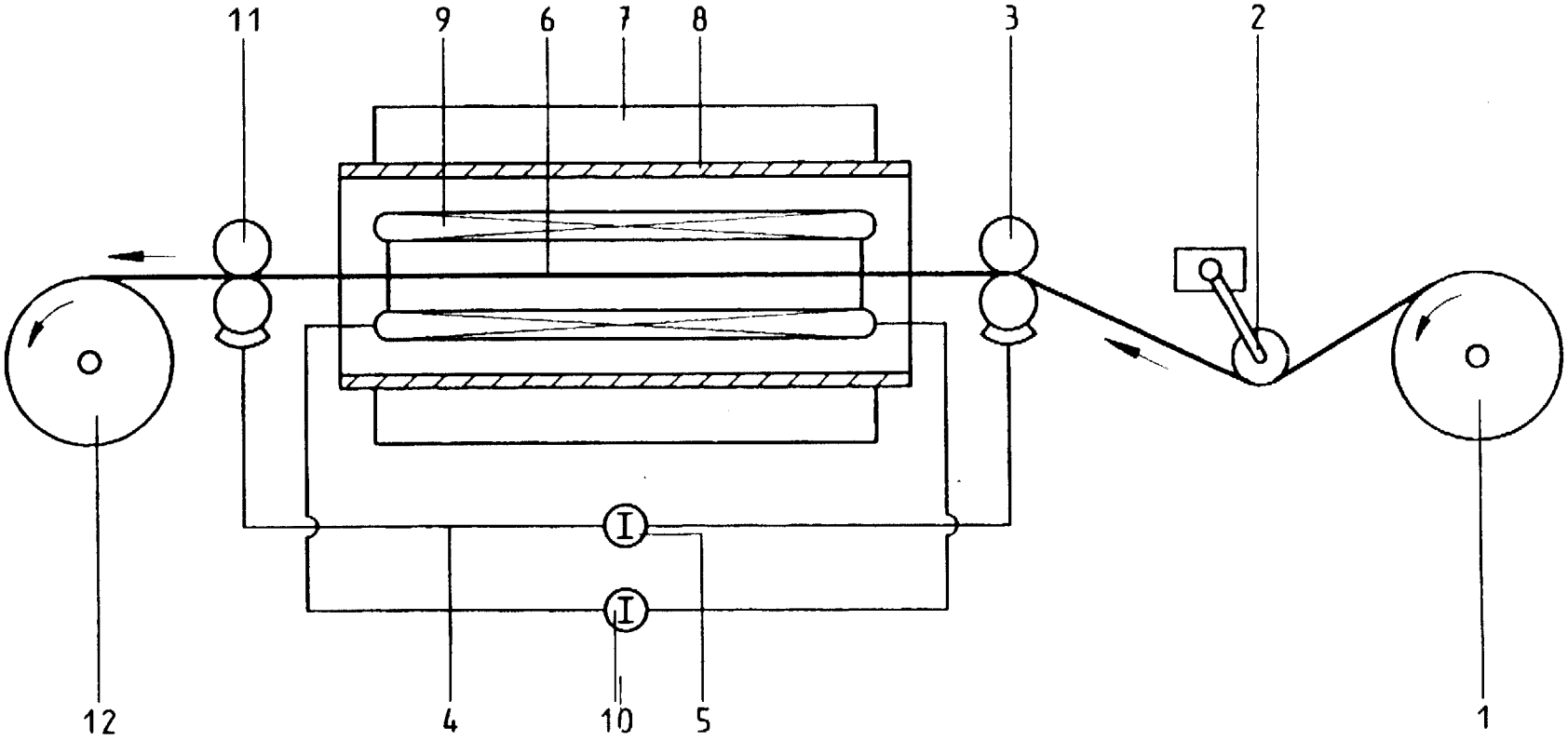
FIG. 1 is a side view of an apparatus for making an elongated member in accordance with the principles of the inventive method.

FIG. 1 shows an example of a heat treatment for a pulse generator according to the invention, in a ribbon embodiment. The amorphous ribbon travels from a supply spool 1 via a tension roller 2 to a first pair of rollers 3, connected with a current source 5 via a supply line 4. After traveling through the first pair of rollers, the amorphous ribbon 6 travels into an oven 7, in which it is surrounded by a shielding tube 8 made of electrically conductive or magnetically soft material, in order to exclude external field influences.

A coil 9 is located in the interior of the shielding tube 8, the coil 9 being connected to a voltage source 10 and generating a longitudinal field that acts on the amorphous ribbon 6. The first pair of rollers 3 and a second pair of rollers 11 serve not only for the supply of the current from the current source 5, but also can be used, by being differentially driven in a suitable manner, to set a determinate tension in the amorphous belt 6.

The current supplied to the amorphous ribbon 6 from the current source 5 can also be used for heating the ribbon 6, but is primarily used for generating a magnetic field that circularly surrounds the amorphous interior of the ribbon 6. After the ribbon 6 has left the oven 7, it travels through the second roller pair 11 and then travels onto a take up spool 12. The ribbon 6 now has the properties required for use as a strip for anti-theft and identification systems, so that the strips according to the invention can be manufactured from it by cutting the ribbon 6 into sections.

It is also possible to treat the ribbon 6 partially or entirely without an artificially produced shielding against external fields, and for example to use the existing terrestrial field as a longitudinal field. With some materials, it can suffice if, during the heat treatment, only the circular field generated by the flow of current acts on the ribbon or the wire, from which the strips are then manufactured. For alloys with positive magnetostriction in particular, the effect caused by the longitudinal field can also be produced by a tension on the ribbon or wire during the heat treatment. Of course, it is also possible to use a longitudinal field and a tension simultaneously.

Although designed for use in anti-theft systems, the inventive strip can be used for identification of products by using one strip or several differently reacting strips or wires are to be arranged in a composite strip, or to use several strips, connected with the identified product.

Figure 2:
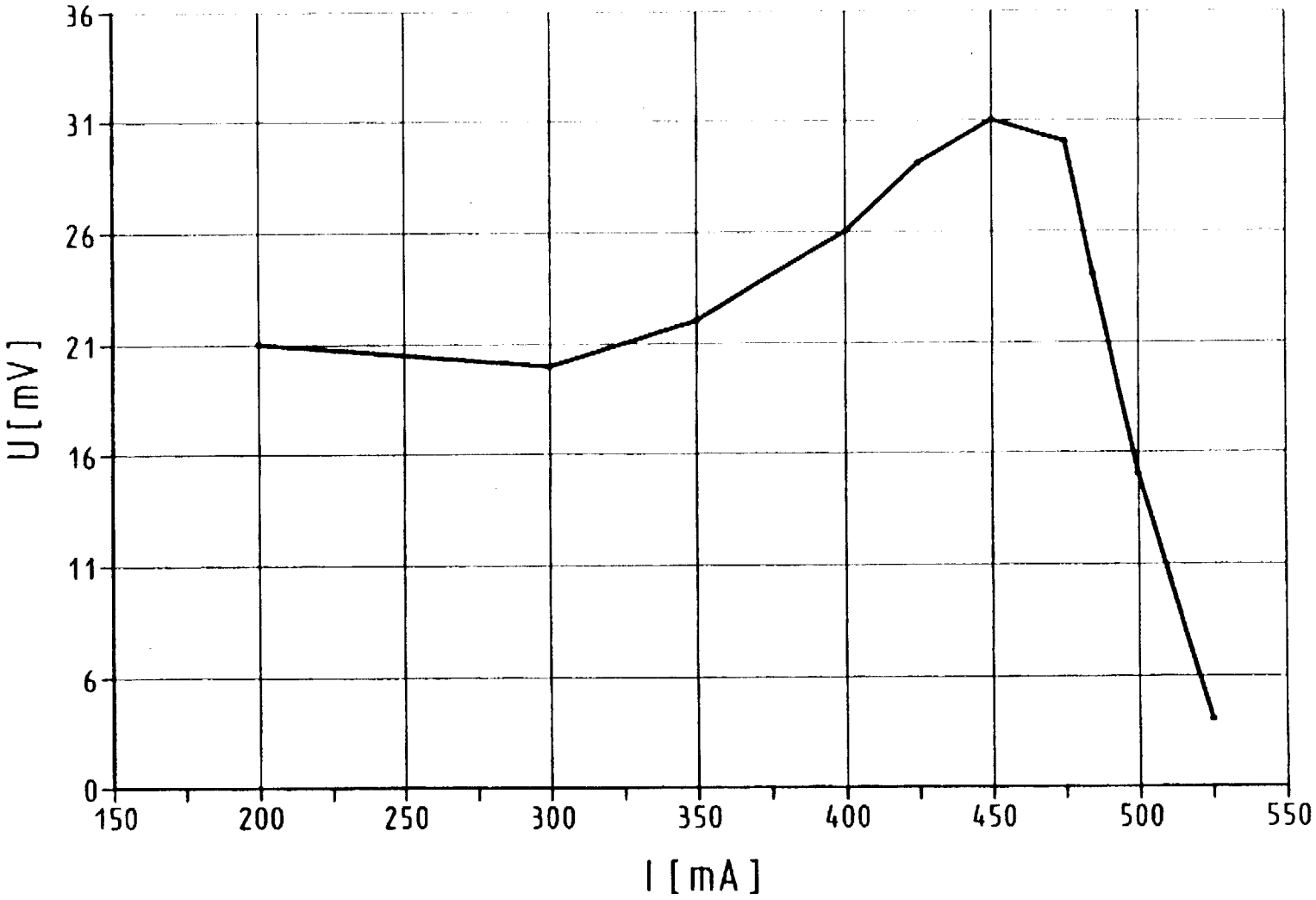
FIG. 2 is a diagram showing the impulse behavior of an elongated member manufactured in accordance with the principles of the inventive method.

For the above-identified exemplary embodiment, FIG. 2 shows the impulse level U in mV, dependent on the current I in mA flowing through the amorphous ribbon 6. To achieve as high an impulse level as possible in an interrogation coil, it is necessary to set determinate levels for the longitudinal field, which, however, depend on the current from the current source 5 and on the cross-section of the amorphous ribbon 6.

Figure 3:
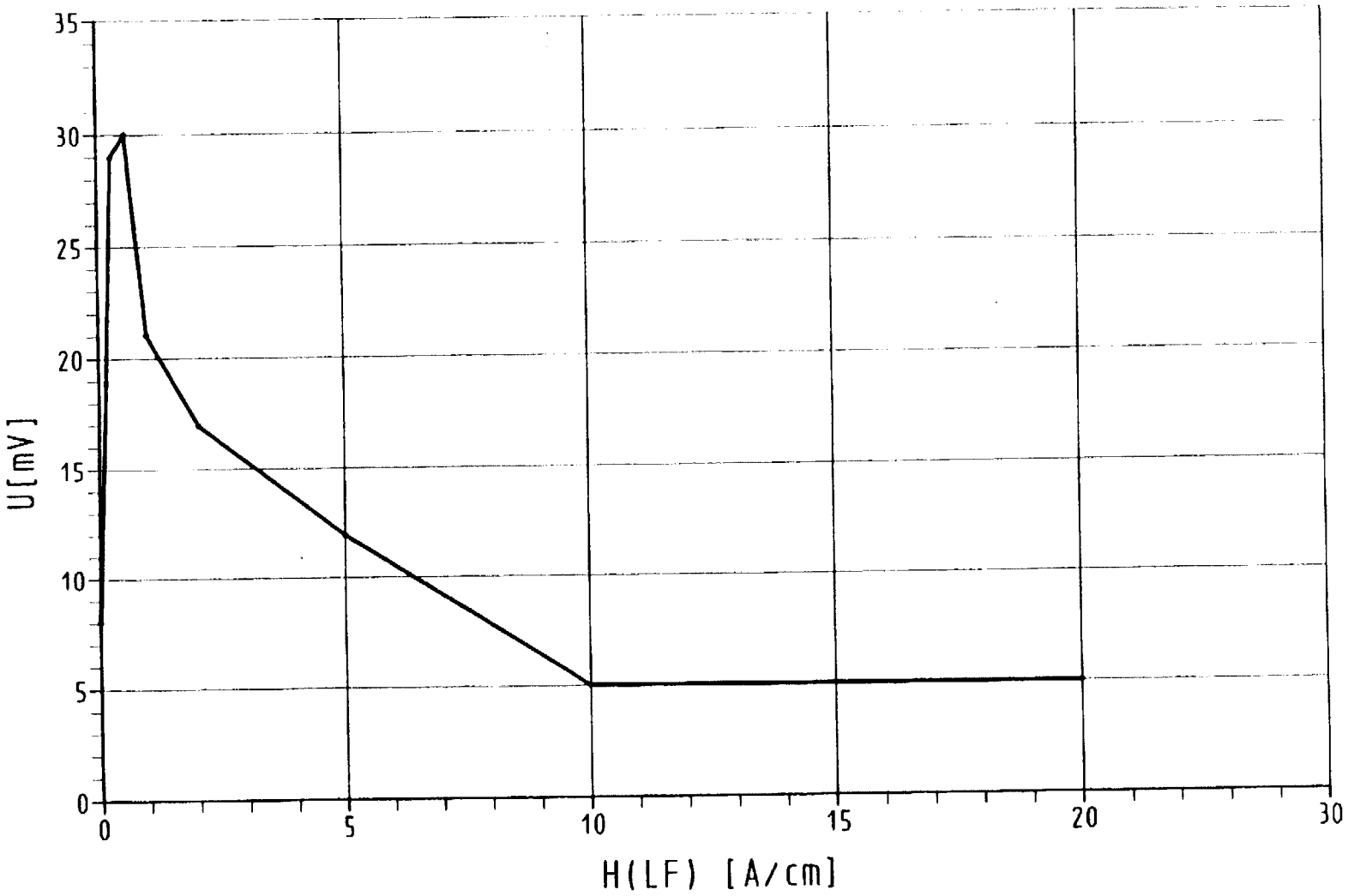
FIG. 3 is a diagram showing the pulse amplitude in relation to the longitudinal field strength in an elongated member manufactured in accordance with the principles of the inventive method.

FIG. 3 shows the level of the measured impulse (voltage U in mV) in relation to the field strength H(LF) of the longitudinal field in A/cm, for the case in which a current I=450 mA flows through the amorphous ribbon 6, the amorphous ribbon 6 remains in the oven 7 for 25 seconds, and a temperature of T=300° C. is present in the oven.

The shape of the curve of magnetization is essential for the impulse level in the use of the amorphous wire or strip with the Barkhausen discontinuity effect for strips in anti-theft or identification systems; this shape can, for example, be described by the remanence ratio, defined by the quotient of the remanence induction Jr to the saturation induction Js (respectively measured in Tesla). Surprisingly, it has been found that neither flat loops nor rectangular loops with a correspondingly higher remanence ratio are advantageous for impulse formation using the inventive strip. Although the optimum impulse level also depends to a small extent on the material used and the dimensions of the strip, during the heat treatment the parameters (longitudinal field, current through the belt and belt tension) must be set so that a remanence ratio results which is between 0.2 and 0.9, preferably between 0.3 and 0.7. For the exemplary embodiment corresponding to FIG. 3, different heat treatments were carried out for this purpose, which led to different remanence ratios.

Figure 4:
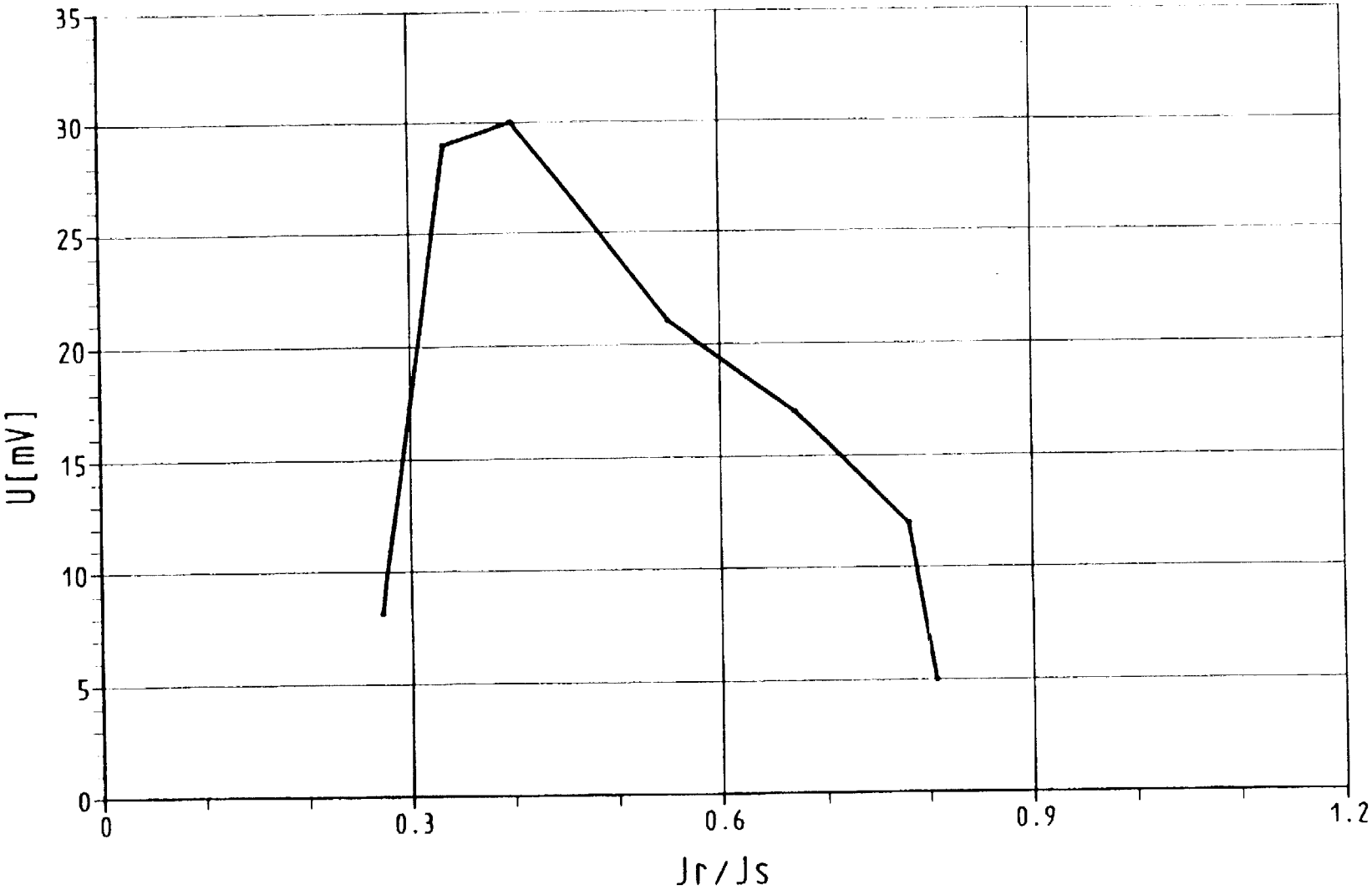
FIG. 4 is a diagram showing the remanence behavior of an elongated member manufactured in accordance with the principles of the inventive method.

The result is shown in FIG. 4. It shows that in these examined strips an optimum of 30 mV was found with a remanence ratio of about 0.4.

To influence the remanence ratio, during the heat treatment it is necessary to vary the relation of the transverse field, which results from the current in the ribbon 6, to the applied longitudinal field. The transverse field, which acts on the ribbon 6 through the current, takes on the value zero in the middle of the ribbon 6, and then increases linearly up to a maximum at the surface of the ribbon 6.

To reach the particularly advantageous remanence relation of between 0.3 and 0.7, the relation of the maximum transverse field to the longitudinal field must be maintained in a range of from 1 to 10 during the heat treatment.

Figure 5:
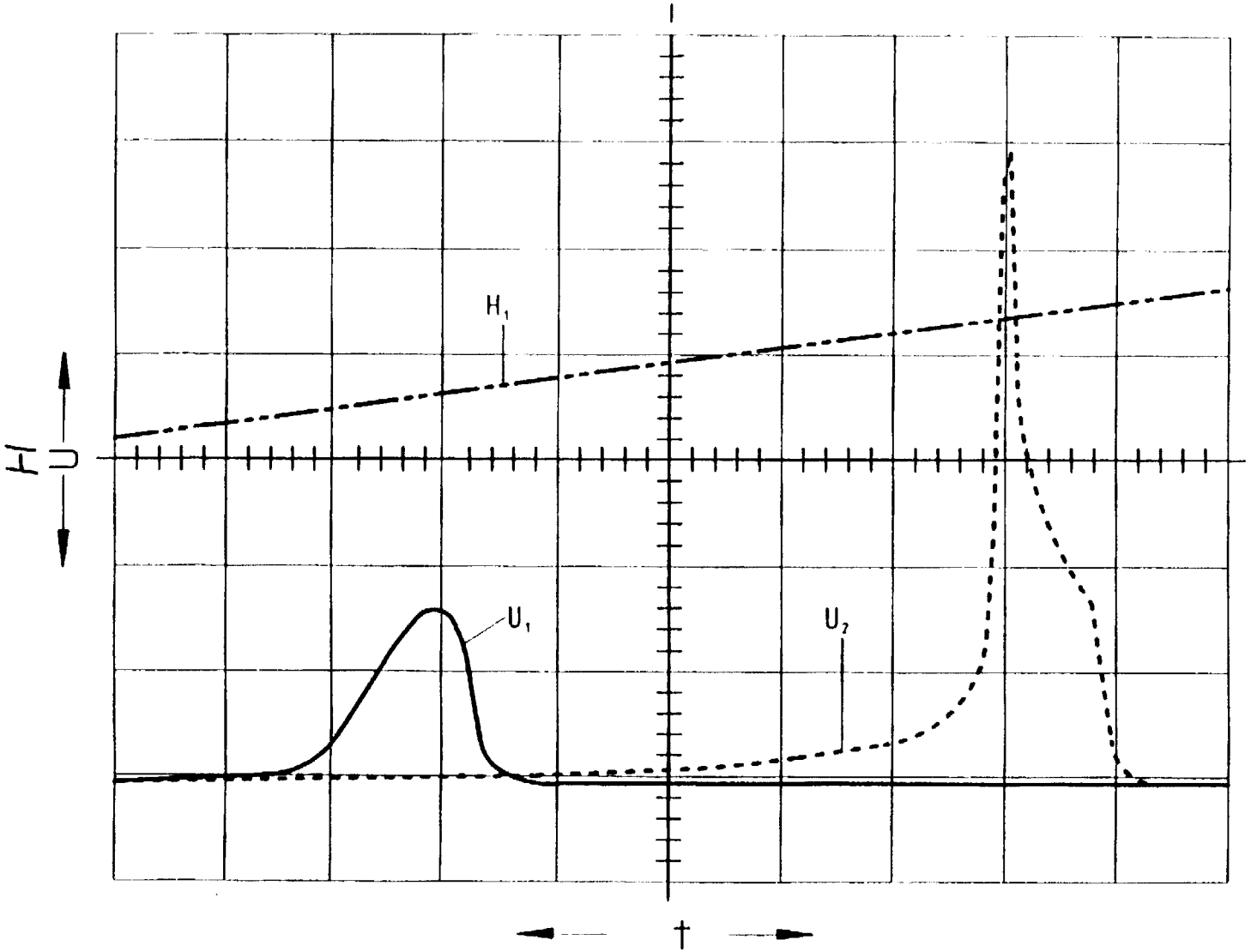
FIG. 5 is a diagram comparing the respective pulse amplitudes in the presence of a field strength increasing over time in an elongated member manufactured in accordance with the principles of the inventive method, and an elongated member manufactured according to U.S. Pat. No. 4,660,025.

For comparison of the inventive strip with a strip whose impulse behavior is determined by inner stresses (produced according to U.S. Pat. No. 4,660,025), the impulse voltage U and the field strength H are plotted against time t in seconds in FIG. 5, as the curve H1 corresponding to the field strength H is continually increased. The curve U1 thereby shows the voltage that results from the use of an amorphous wire having a length of 90 mm and a diameter of 0.13 mm, in comparison to the voltage curve corresponding to the curve U2 with the use of an inventive amorphous strip having the dimensions: width 2 mm, thickness 23 μm and the same length of 90 mm. It can be seen that the peak voltage of the impulse occurs in the inventive amorphous strip at a higher field strength, but a considerably higher voltage impulse and a steep leading edge of the voltage results. The measurements show that the voltage impulse in the inventive amorphous strip amounts to about 120 mV, while with the amorphous wire a maximum voltage amplitude of 30 mV was attainable.

Particularly advantageous alloys for the provided application result by using a cobalt portion of between 60 and 85 at-%, and by setting the iron/manganese ratio, which determines the magnetostriction constant, in a range from 1 to 10 at-% to produce a magnetostriction that is as low as possible, preferably less than $\pm 4\times10^{-6}$.

For the determination of advantageous alloys for the present case of application, alloys are to be chosen that satisfy the following formula:

$$Co_aNi_b(Fe,Mn)_c(Si,B,X)_d$$

with, in at-%:

a=20–85; b=0–50; c=0–15 and d=15–30, whereby a+b+d+c=100. X thereby designates either one or several of the transition metals of groups IIIB–VIB, such as e.g. Nb, Mo, Ta, W, V, etc., and/or one or several elements of main groups IIIA–VA, such as e.g. C, P, Ge.

By means of permanent magnets, not only is it possible to alter the reaction field strength in dependence on the direction of magnetic reversal, but also it is possible (as in known magnetically soft strips) to saturate the strips by means of a somewhat stronger permanent magnet and thus to switch off the impulse behavior. In this way, a deactivatable security strip can be obtained.

Advantageous dimensions for the amorphous strip that is used in the inventive strip, either alone or together with other materials, are at a length up to 100 mm, with a width of up to 5 mm and a thickness of a maximum of 50 μm for the strip or for the diameter of the wire. Shorter strips that still have a sufficient impulse level, however, are also possible. At a length up to 60 mm, the advantageous dimensions are a width of up to 3 mm and a strip thickness up to 40 μm at the most.

With these dimensions, it is also possible to produce strips with lengths less than 40 mm. Advantageously, the switching field strength becomes higher as the strip becomes shorter. In a strip up to 40 mm, this strength can, for example, be a maximum of 1.5 A/cm, in a strip of up to 60 mm a maximum of 1.0 A/cm, and in a strip up to 100 mm a maximum of 0.75 A/cm.

For example, an amorphous strip of the alloy composition (1) has been used. This strip had the dimensions 1.0×0.023 mm, a Curie temperature of Tc=485° C. and a saturation induction of 1.0 T. A strip of this sort, having a length of 40 mm, was saturated with a maximum field strength of H=1.2 A/cm, and the impulses thereby generated were determined in an interrogation coil with 200 windings. The ratio of the remanence induction Jr to the saturation induction Js was measured in 150 mm-long strips, in order to exclude the influence of the demagnetization effect. The following values resulted:

| Result | | Method parameter | | | | Tension |
|---|---|---|---|---|---|---|
| U{mV} | Jr/Js | T{°C.} | t{s} | I{mA} | HLF{{A/cm} | {MPa} |
| 31 | 0.41 | 300 | 25 | 450 | 0.5 | 45 |
| 20 | 0.58 | 300 | 25 | 200 | 0.5 | 45 |
| 4 | 0.14 | 300 | 25 | 525 | 0.5 | 45 |
| 12 | 0.65 | 300 | 25 | 450 | 5 | 45 |

If relatively short lengths of less than 50 mm are used, for reducing the demagnetization effect of the strip a correspondingly smaller cross-section must be used, so that a sufficient signal level is nonetheless reached. For the manufacture of the strip, first an amorphous ribbon (or a wire) is manufactured in the standard way, through rapid quenching from the melted state.

If a wire is used in place of a strip, after manufacture this wire can be reduced in cross-section by mechanical deformation by means of rapid solidification, and also can be modified; for example, a flat-rolled wire with a rectangular or elliptical cross-section can be produced.

In a further embodiment of the present invention, the signal level can be increased given tempered ribbons, for short strip lengths, i.e. for strip lengths between 20 and 40 mm, by arranging longitudinal strips made of a magnetically soft material at the ends of the tempered amorphous strip. A increase in the signal level of up to a factor of 10 is thereby achieved. For untempered strips, the signal level is increased roughly by a factor of from 1 to 2.

The spacing between the strips should not be less than 10 mm. The maximum impulse level, i.e. the optimal position, depends in particular on the strip length of the amorphous strip and on the dimensions of the magnetically soft longitudinal strips.

A good direct contact between the amorphous strips and the magnetically soft strips is necessary, for which an outer pressure by means of an adhesive strip is sufficient.

Likewise, a clear signal rise is achieved by the respective arranging of two magnetically soft strips on the respective ends of the amorphous strip, above and below.

Although modifications and changes may be suggested by those skilled in the art, it is the intention of the inventors to embody within the patent warranted hereon all changes and modifications as reasonably and properly come within the scope of their contribution to the art.

We claim as our invention:

1. An elongated member for use as a pulse generator in an electromagnetic anti-theft/article identification system wherein a magnetization of the elongated member is suddenly reversed, due to a Barkhausen discontinuity, upon reversal of a direction of in an interrogation zone containing an alternating magnetic field when a predetermined threshold value is reached and thereby triggering characteristic voltage pulses in an interrogation coil associated with the interrogation zone, said elongated member comprising:

a member of amorphous material having a cobalt content of at least 20 at-% (20 atomic percent), and having a magnetic anisotropy in the member produced by a heat treatment with a current flow through the member giving said member a ratio of remanence induction to saturation induction in a range between 0.2 and 0.9.

2. An elongated member as claimed in claim 1, wherein said member has a ratio of remanence induction to saturation induction in a range between 0.3 and 0.7.

3. An elongated member as claimed in claim 1, wherein the amorphous material of the member consists of an alloy that satisfies the formula $$Co_aNi_b(Fe,Mn)_c(Si,B,X)_d,$$

wherein, in at-%, a=20–85; b=0–50; c=0–15 and d=15–30, wherein a+b+d+c, including standard impurities, equals 100, and wherein X designates at least one element selected from the group consisting of the transition metals of groups IIIB–VIB of the periodic table, and the elements of the main groups IIIA–VA of the periodic table.

4. An elongated member as claimed in claim 3, wherein X designates at least one element selected from the group consisting of the transition metals of groups IIIB–VIB of the periodic table and at least one element selected from the group consisting of the elements of the main groups IIIA–VA of the periodic table.

5. An elongated member as claimed in claim 3, wherein X designates at least one element selected from the group consisting of Nb, Mo, Ta, W, V, C, P and Ge.

6. An elongated member as claimed in claim 3, wherein X designates at least one element selected from the group consisting of Nb, Mo, Ta, W and V, and at least one element selected from the group consisting of C, P and Ge.

7. An elongated member as claimed in claim 3, having a cobalt content greater than 40 at-%.

8. An elongated member as claimed in claim 3, having a cobalt content greater than 60 at-%.

9. An elongated member as claimed in claim 3, having an iron content in a range from between 1 to 10 at-%.

10. An elongated member as claimed in claim 3, having an manganese content in a range from between 1 to 10 at-%.

11. An elongated member as claimed in claim 3, having an iron and manganese content in a range from between 1 to 10 at-%.

12. An elongated member as claimed in claim 1, further comprising at least one magnetically soft member, attached to said member of amorphous material, having a direction of magnetization which continually reverses upon reversal of the direction of magnetization of said alternating field.

13. An elongated member as claimed in claim 12, wherein said magnetically soft member has a coercive field strength of less than 30 mA/cm and having a cross section which, when multiplied by said saturation induction, is higher than the remanence induction of said member of amorphous material.

14. An elongated member as claimed in claim 12, wherein said magnetically soft member has a length which is larger than a length of said member of amorphous material, and wherein said magnetically soft member is attached to said member of amorphous material so that said magnetically soft member projects beyond said member of amorphous material at opposite ends of said member of amorphous material.

15. An elongated member as claimed in claim 1, further comprising at least one additional member of an alloy having a magnetostriction of less than $\pm 4\times10^{-6}$ and which has a magnetization reversal behavior unaffected by mechanical stress.

16. An elongated member as claimed in claim 1, wherein said member of amorphous material consists of an alloy having a positive magnetostriction.

17. An elongated member as claimed in claim 1, further comprising a magnetically hard member for premagnetization, attached to said member of amorphous material, said magnetically hard member having a magnetic field for producing different threshold values upon reversal of the direction of magnetization of said alternating field, dependent on a direction of magnetization of said member of amorphous material.

18. An elongated member as claimed in claim 1, further comprising a permanent magnet having a magnetized state which deactivates said member of amorphous material by saturating said member of amorphous material.

19. An elongated member as claimed in claim 1, wherein said member of amorphous material has a length of up to 100 mm, a width of less than 5 mm and a thickness of less than 50 μm.

20. An elongated member as claimed in claim 1, wherein said member of amorphous material has a length of up to 60 mm, a width of up to 3 mm and a thickness of up to 40 μm.

21. An elongated member as claimed in claim 1, wherein said member of amorphous material has a length of up to 40 mm, a width of up to 3 mm and a thickness of up to 40 μm.

22. An elongated member as claimed in claim 1, wherein said member of amorphous material reverses its magnetization in an alternating field having a field strength of less than 0.75 A/cm.

23. An elongated member as claimed in claim 1, wherein said member of amorphous material reverses its magnetization in an alternating field having a field strength of less than 1.0 A/cm.

24. An elongated member as claimed in claim 1, wherein said member of amorphous material reverses its magnetization in an alternating field having a field strength of less than 1.5 A/cm.

25. An elongated member as claimed in claim 1, wherein said member of amorphous material comprises a strip.

26. An elongated member as claimed in claim 1, wherein said member of amorphous material comprises a wire.

27. An elongated member as claimed in claim 1, wherein said member of amorphous material comprises a wire having a round cross-section.

28. An elongated member as claimed in claim 1, wherein said member of amorphous material comprises a wire having an elliptical cross-section.

29. A method of making an elongated member for use as a pulse generator in an electromagnetic anti-theft/article identification system wherein a magnetization of the elongated member is suddenly reversed, due to a Barkhausen discontinuity, upon reversal of a direction of in an interrogation zone containing an alternating magnetic field when a predetermined threshold value is reached and thereby triggering characteristic voltage pulses in an interrogation coil associated with the interrogation zone, said method comprising the steps of:

producing a continuous length of amorphous material having a cobalt content of at least 20 at-% by rapid solidification from a molten state, thereby obtaining a solidified continuous length of amorphous material; and producing a characteristic magnetization reversal in said solidified continuous length of amorphous material by setting a magnetic anisotropy therein by passing a current through said solidified continuous length of amorphous material while passing said solidified continuous length of amorphous material through an oven with an elevated temperature to produce a ratio of remanence induction to saturation induction in said solidified continuous length of amorphous material between 0.2 and 0.9.

30. A method as claimed in claim 29, wherein said solidified continuous length of amorphous material has a longitudinal direction and wherein the step of passing said current through said solidified continuous length of amorphous material comprises passing said solidified continuous length of amorphous material through said oven in the presence of a longitudinal field with said current passing through said solidified continuous length of amorphous material in said longitudinal direction.

31. A method as claimed in claim 30, wherein the step of passing said current through said solidified continuous length of amorphous material comprises passing a current through said solidified continuous length of amorphous material to produce a maximum transverse field in said solidified continuous length of amorphous material having a ratio relative to said longitudinal field in a range from 1 to 10.

32. A method as claimed in claim 29, wherein said solidified continuous length of amorphous material has a longitudinal direction and wherein the step of passing said current through said solidified continuous length of amorphous material comprises passing said solidified continuous length of amorphous material through said oven under tension with said current passing through said solidified continuous length of amorphous material in said longitudinal direction.

33. A method as claimed in claim 29 comprising the additional step of cutting said solidified continuous length of amorphous material into a plurality of members after passage through said oven.

34. A method as claimed in claim 29 wherein the step of producing a characteristic magnetization reversal comprises producing a ratio of remanence induction to saturation induction in said solidified continuous length of amorphous material between 0.3 and 0.7.

35. A method as claimed in claim 29 wherein the step of producing a continuous length of amorphous material comprises producing a continuous length of amorphous consisting of an alloy satisfying the formula $$Co_aNi_b(Fe,Mn)_c(Si,B,X)_d,$$

wherein, in at-%, a=20–85; b=0–50; c=0–15 and d=15–30, wherein a+b+d+c, including standard impurities, equals 100, and wherein X designates at least one element selected from the group consisting of the transition metals of groups IIIB–VIB of the periodic table, and the elements of the main groups IIIA–VA of the periodic table.

36. A method as claimed in claim 29 further comprising selecting X as at least one element from the group consisting of the transition metals of groups IIIB–VIB of the periodic table and at least element from the group consisting of the elements of the main groups IIIA–VA of the periodic table.

37. A method as claimed in claim 29 comprising selecting X as at least one element from the group consisting of Nb, Mo, Ta, W, V, C, P and Ge.

38. A method as claimed in claim 29 comprising selecting X as at least one element from the group consisting of Nb, Mo, Ta, W and V, and at least one element selected from the group consisting of C, P and Ge.

39. A method as claimed in claim 29 wherein the step of producing said continuous length of amorphous material comprises producing a continuous length of amorphous material having a cobalt content greater than 40 atomic percent.

40. A method as claimed in claim 29 wherein the step of producing said continuous length of amorphous material comprises producing a continuous length of amorphous material having a cobalt content greater than 60 atomic percent.

41. A method as claimed in claim 29 wherein the step of producing said continuous length of amorphous material comprises producing a continuous length of amorphous material having an iron content in a range from 1 to 10 atomic percent.

42. A method as claimed in claim 29 wherein the step of producing said continuous length of amorphous material comprises producing a continuous length of amorphous material having an manganese content in a range from 1 to 10 atomic percent.

43. A method as claimed in claim 29 wherein the step of producing said continuous length of amorphous material comprises producing a continuous length of amorphous material having an iron and manganese content in a range from 1 to 10 atomic percent.

44. A method as claimed in claim 29 comprising the additional steps of forming an amorphous member from said solidified continuous length of amorphous material and attaching at least one magnetically soft member to said member of amorphous material, having a direction of magnetization which continually reverses upon reversal of the direction of magnetization of said alternating field.

45. A method as claimed in claim 44 comprising the additional steps of forming an amorphous member from said solidified continuous length of amorphous material and selecting said magnetically soft member as a magnetically soft member having a coercive field strength of less than 30 Ma/cm and having a cross-section which, when multiplied by said saturation induction, is higher than the remanence induction of said member of amorphous material.

46. A method as claimed in claim 44 wherein the step of attaching said at least one magnetically soft member to said member of amorphous material comprises providing said magnetically soft member with a length larger than a length of said member of amorphous material, and attaching said magnetically soft member to said member of amorphous material so that said magnetically soft member projects beyond said member of amorphous material at opposite ends of said member of amorphous material.

47. A method as claimed in claim 29 comprising the additional steps of forming an amorphous member from said solidified continuous length of amorphous material and attaching at least one additional member to said member of amorphous material of an alloy having a magnetostriction less than $\pm 4\times 10^{-6}$ and which has a magnetization reversal behavior unaffected by mechanical stress.

48. A method as claimed in claim 29 wherein the step of producing said continuous length of amorphous material comprises producing a continuous length of amorphous material having a positive magnetostriction.

49. A method as claimed in claim 29 comprising the additional steps of forming an amorphous member from said solidified continuous length of amorphous material and attaching a magnetically hard member to said member of amorphous material, said magnetically hard member having a magnetic field for producing different threshold values upon reversal of the direction of magnetization of said alternating field, dependent on a direction of magnetization of said member of amorphous material.

50. A method as claimed in claim 29 wherein the step of producing said continuous length of amorphous material comprises producing a continuous length of amorphous strip.

51. A method as claimed in claim 29 wherein the step of producing said continuous length of amorphous material comprises producing a continuous length of amorphous wire.

52. A method as claimed in claim 29 wherein the step of producing said continuous length of amorphous material comprises producing a continuous length of amorphous wire having a circular cross-section.

53. A method as claimed in claim 29 wherein the step of producing said continuous length of amorphous material comprises producing a continuous length of amorphous wire having a elliptical cross-section.

54. A method as claimed in claim 35 wherein the step of producing a characteristic magnetization reversal comprises producing a ration of remanence induction to saturation induction in said solidified continuous length of amorphous material between 0.3 and 0.7.

55. A method for producing a pronounced pulse in an electromagnetic anti-theft/article identification system comprising:

producing a member of amorphous material having a cobalt content of at least 20 atomic percent and having a magnetic anisotropy in the member, including a Barkhausen discontinuity, produced by a heat treatment with a current flow through the member giving said member a ration of remanence induction to saturation induction in a range between 0.2 and 0.9;

passing said member through an alternating magnetic field for causing a sudden reversal, due to said Barkhausen discontinuity, of magnetization of said member; and detecting said reversal of magnetization in said member in an interrogation coil and generating a voltage pulse corresponding thereto.

56. A method as claimed in claim 55 wherein the step of producing a member of amorphous material comprises producing a continuous length of amorphous consisting of an alloy satisfying the formula $$Co_aNi_b(Fe,Mn)_c(Si,B,X)_d,$$

wherein, in at-%, a=20–85; b=0–50; c=0–15 and d=15–30, wherein a+b+d+c, including standard impurities, equals 100, and wherein X designates at least one element selected from the group consisting of the transition metals of groups IIIB–VIB of the periodic table, and the elements of the main groups IIIA–VA of the periodic table.

* * * * *